United States Patent [19]

Crescenzi et al.

[11] 4,211,322

[45] Jul. 8, 1980

[54] SELF-JOINED INTERLOCKING CONTAINER

[75] Inventors: Donald Crescenzi, Killingworth; Barry A. Bridges, Bloomfield, both of Conn.

[73] Assignee: Leigh Products, Inc., Coopersville, Mich.

[21] Appl. No.: 962,372

[22] Filed: Nov. 20, 1978

[51] Int. Cl.[2] ..... B65D 5/22

[52] U.S. Cl. ..... 206/44 R; 229/33; 229/34 R

[58] Field of Search ..... 229/33, 34 R; 206/44 R

[56] References Cited

U.S. PATENT DOCUMENTS

| | | | |
|---|---|---|---|
| 2,464,904 | 3/1949 | Tomarin | 229/34 R |
| 3,164,350 | 1/1965 | Taub | 206/44 R X |
| 3,899,119 | 8/1975 | Roccaforte | 229/33 X |
| 4,053,101 | 10/1977 | Hart | 229/34 R X |

*Primary Examiner*—Donald F. Norton

*Attorney, Agent, or Firm*—DeLio and Montgomery

[57] ABSTRACT

A self-joined interlocking container that functions both as a shipping container and a display container. The top portion of the container is removable. The sides decline toward the front to facilitate display of the contents of the package. The container is formed so that the raw edges along the front or sides are hidden.

6 Claims, 10 Drawing Figures

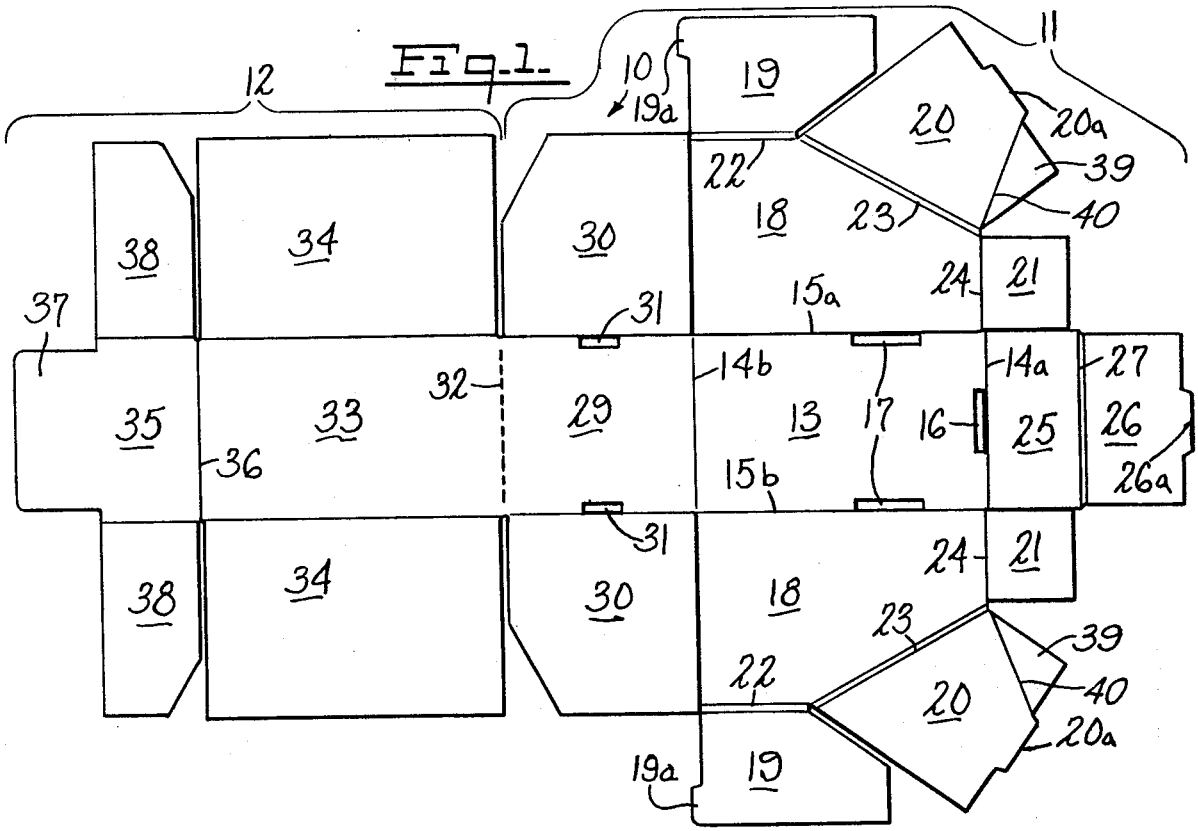
Fig.1.
12
10
19a
19
20
20a
11
39
40
22
18
23
38
34
30
24
21
37
31
15a
14b
14a
27
35
33
32
29
13
17
16
25
26
36
15b
26a
31
24
21
38
34
30
18
23
39
22
20
40
20a
19a
19
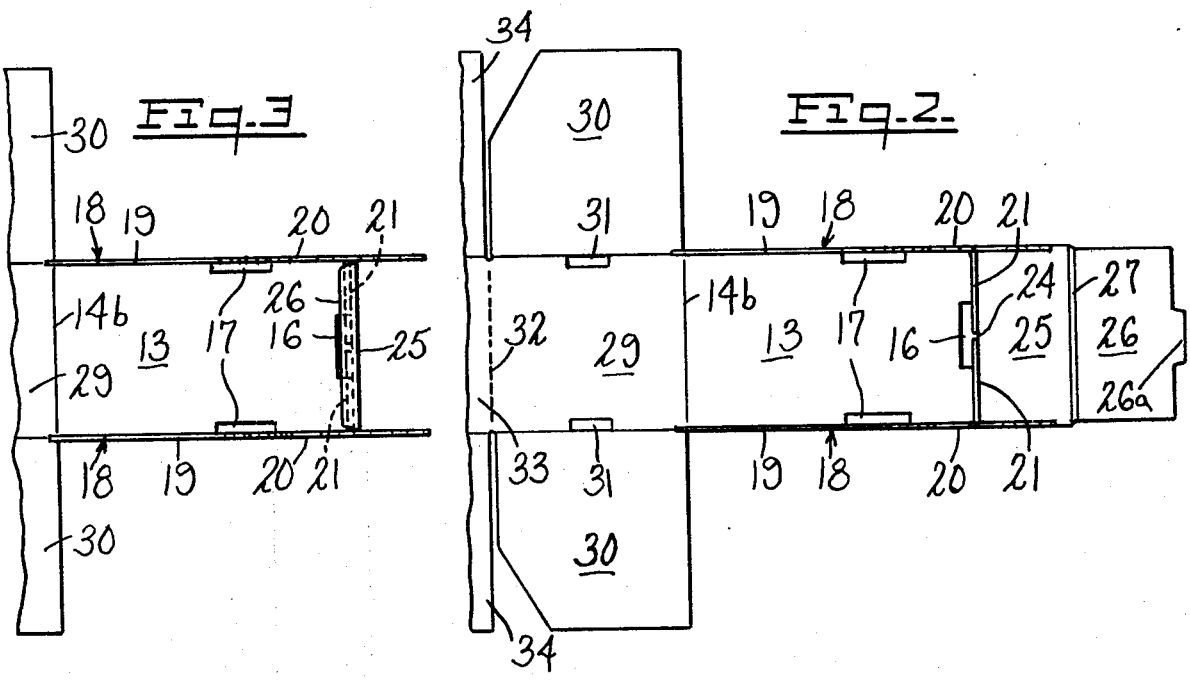
Fig.3
30
18
19
20
21
26
14b
13
17
16
25
29
18
19
20
21
30
Fig.2.
34
30
31
19
18
20
21
24
27
14b
32
29
13
17
16
25
26
26a
33
31
19
18
20
21
30
34

SELF-JOINED INTERLOCKING CONTAINER

BACKGROUND OF THE INVENTION

The invention relates generally to the field of packaging containers, and more specifically to shipping containers adaptable for use in displays.

Combination shipping and display containers are known in the prior art. Such containers normally have sides that slope to the front to permit the contents to be easily viewed and removed. However, in the display containers of the prior art, the top edges of the sloping sides and front have exposed the cut edges of the sheet material from which the containers are made. Such edges, particularly if the container is formed from corrugated material, are generally unsightly, and the material can be easily peeled back or otherwise tattered, reducing the structural integrity of the container, and resulting in an unsightly display.

Prior art containers also require adhesive joints or similar fastening means to be erected. This increases manufacturing expense, as the additional steps of applying the adhesive requires additional machinery and time to assemble, and increases the expense of assembly, as care must be taken to avoid contact with the adhesive.

The present invention obviates these deficiencies by providing a combination shipping and display container in which the top thereof may be removed, yielding a display package of improved aesthetic appeal and structural integrity. The package is self-joining and interlocking, obviating the need for adhesive or similar fastening means to erect the container.

SUMMARY OF THE INVENTION

It is therefore an object of the invention to provide a new and improved combination shipping and display container in which the display portion of the container has sides and front which have no exposed raw edges.

It is another object of the invention to provide a display and shipping container of enhanced structural integrity and aesthetic appeal.

It is yet another object of the invention to provide a new and improved shipping and display container which is self-joining and interlocking, obviating the need for adhesive or similar fastening means.

In brief, the invention provides a self-joined interlocking combination shipping and display container, and a blank adapted to be folded thereinto. The package is formed from a one-piece blank and includes a base panel, inner side panels, a rear panel and a lower front panel. The inner side panels include tabs which interlock with the lower front panel. The rear panel has tabs which interlock with the two side panels to maintain the rear panel upright. The container further includes a top panel and outer side panels which descend therefrom and an upper front panel. The side panels include tabs to facilitate interlocking with the rear panel tabs which prevent the raw edges of the sides from being seen. Similarly, the interlocking feature of the side panel tabs and the lower front panel hides the raw edge thereof.

BRIEF DESCRIPTION OF THE DRAWINGS

The features of the invention which are believed to be novel are particularly pointed out and distinctly claimed in the concluding portion of this specification. The invention, however, both as to its organization and operation together with further objects and advantages thereof may best be appreciated by reference to the following detailed description taken in conjunction with the drawings, wherein:

FIG. 1 is a top plan view of a blank according to the invention;

FIGS. 2, through 5 are top plan views showing successive steps in assemblying a container from the blank of FIG. 1;

BRIEF DESCRIPTION OF THE PREFERRED EMBODIMENT

Figure 4:
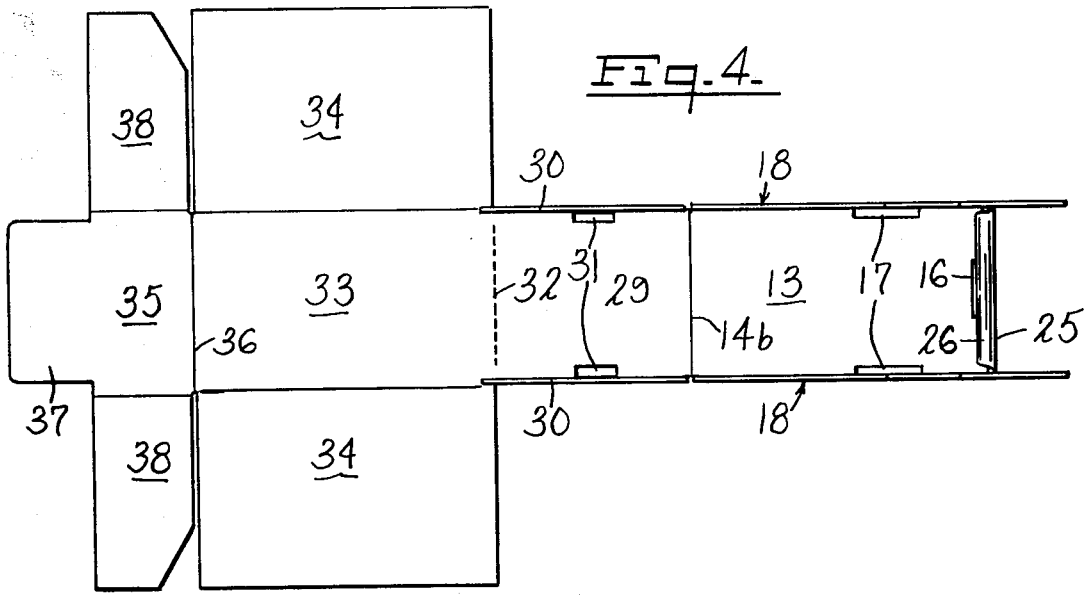

With reference to FIG. 1, the invention provides a blank 10 including a lower display portion 11 and an upper portion 12. Display portion 11 includes a base panel 13 bounded by a first pair of parallel folding creases 14*a* and 14*b* and a second pair of parallel folding creases 15*a* and 15*b*. Base panel 13 further includes a forward slot 16 adjacent the folding crease 14*a* and two side slots 17, one adjacent crease 15*a* and the other adjacent crease 15*b*.

Extending outwardly from opposite sides of base panel 13 and bounded by folding creases 15*a* and 15*b* are two inner side panels 18. Extending outwardly from each inner side panel 18 is a rear side tab 19, a forward side tab 20. Tab 19 includes a short tongue 19*a* extending rearwardly therefrom, and tab 20 includes a short tongue 20*a* extending outwardly therefrom. Extending forwardly of each inner side panel 18 is a forward tab 21. Tabs 19, 20 and 21 are bounded by creases 22, 23 and 24, respectively.

Forward (to the right as shown in FIG. 1) of base panel 13 is a lower front panel 25. A tab 26 is formed on lower front panel 25 bounded by crease 27. Tab 26 includes a short tongue 26*a* extending forwardly therefrom.

A rear panel 29 extends rearwardly (to the left as shown in FIG. 1) of base panel 11 and is separated therefrom by crease 14*b*. Extending outwardly from rear panel 29 are two tabs 30 bounded by folding creases 15*a* and 15*b*. Two slots 31 are formed in rear panel 29 adjacent creases 15*a* and 15*b*, one slot being adjacent each crease.

Blank 10 further includes a top panel 33 attached to rear panel 29 through a third folding crease 32 which in the embodiment shown is perforated and which is parallel to crease 14*b*. Extending outwardly from top panel 33 are two outer side panels 34 bounded by creases 15*a* and 15*b*. To the rear of top panel 33 is an upper front panel 35 attached to top panel 33 through a fourth folding crease 36, which is also parallel to folding crease 14*b*. Upper front panel 35 includes a large tongue 37 and two outwardly extending tabs 38. The tabs 38 are bounded by folding creases 15*a* and 15*b*.

FIGS. 2 through 9 exemplify one method of erecting a shipping and display container from blank 10. As exemplified in FIG. 2, inner side panels 18 are folded upwardly orthogonal to base panel 13 along folding creases 15*a* and 15*b*. Tabs 21 are folded along creases 24 so as to be orthogonal to both inner side panels 18 and base 13.

As exemplified in FIG. 3, lower front panel 25 is folded along crease 14*a* so as to be orthogonal to base panel 13 and adjacent tabs 21. Tab 26 is folded downwardly along crease 27 towards base panel 13. Tongue 26*a*, extending from tab 26, is inserted into slot 16 in base panel 13 to lock lower front panel 25 around tabs 21.

Figure 5:
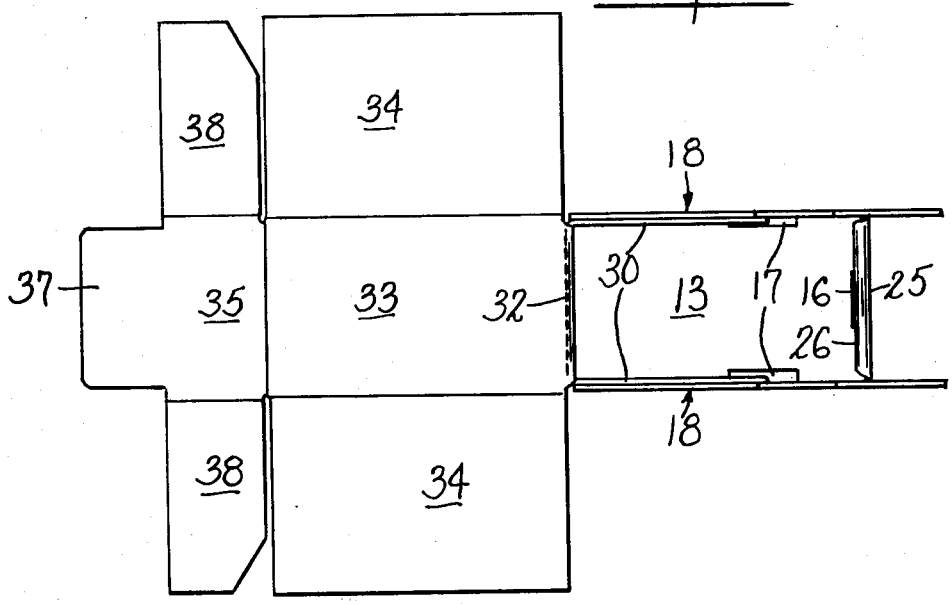
Figure 6:
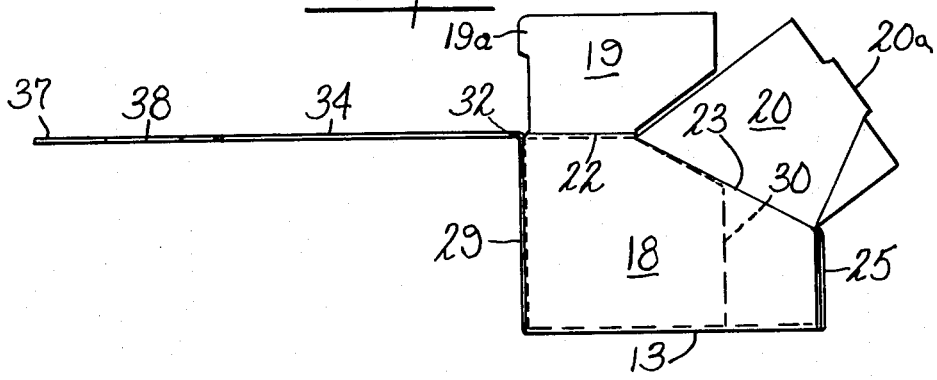
FIG. 6 is a side view of the container shown in FIG. 5.

As exemplified in FIGS. 4, 5 and 6, tabs 30 are folded upwardly orthogonal to rear panel 29 along creases 15*a* and 15*b*. Rear panel 29 is folded along proximate crease 14*b* so that rear panel 29 is orthogonal to base panel 13, and tabs 30 are positioned interiorally of side panels 18. Top panel 33 is folded along folding crease 32 to maintain its horizontal relationship parallel to base 13. As exemplified in FIG. 7, tab 19 from inner side panel 18 is folded downwardly over tab 30 along crease 22. Tongue 19*a* of rear tab 19 is inserted into slot 31 in rear panel 29.

As an alternative to the method disclosed in FIGS. 2 through 7, rear panel 29 is folded upwardly along crease 14*b*. Tabs 30 are folded inwardly. Inner side panels 18 are folded upwardly along creases 15*a* and 15*b* and the forward tabs 21 are folded inwardly. Lower front panel 25 is folded upwardly and tab 26 is folded downwardly and rearwardly interlocking tabs 21. Tabs 19 and 20 are then folded over interlocking tabs 30 to hold the rear panel 29 in an upright position.

The container is now ready for filling.

Figure 8:
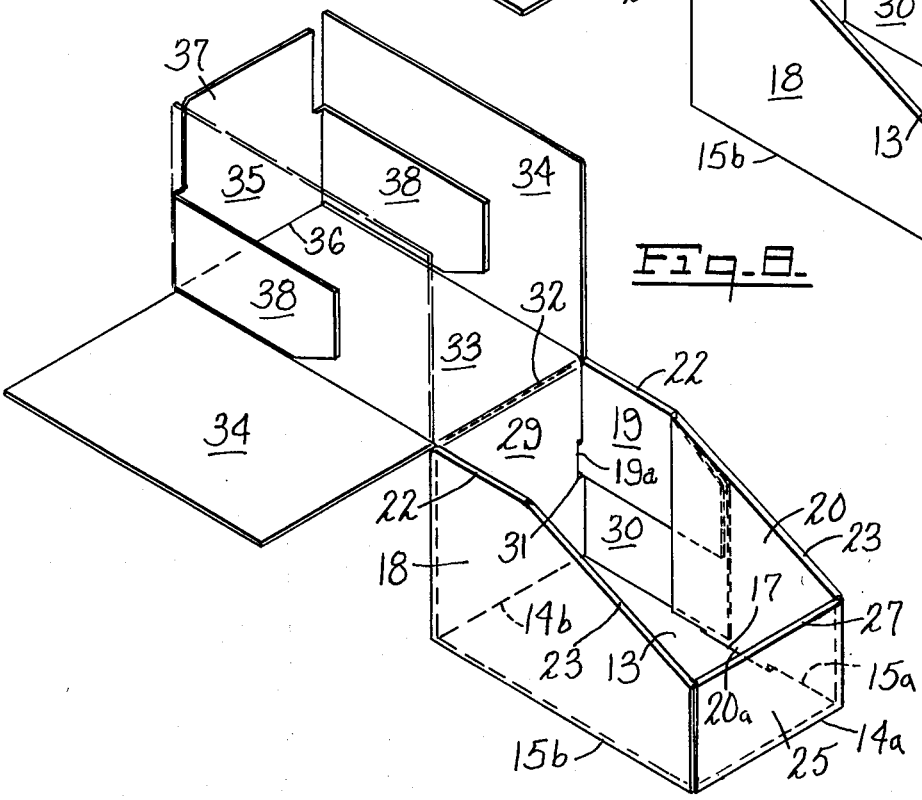

As exemplified in FIG. 8, tab 20 is folded along crease 23 to partially overlie both tab 19 and tab 30. A small tail portion 39 of tab 20 may be folded slightly along line 40 to avoid lower front panel 25 as the tab is being folded.

Upper front panel 35 is folded upwardly along folding crease 36 so as to be orthogonal to top panel 33. Tabs 38 are folded along the proximate creases 15*a* and 15*b* orthogonal to both upper front panel 35 and top panel 33. Outer side panels 34 are folded upwardly along the proximate folding creases 15 exteriorally of tabs 38.

Figure 9:
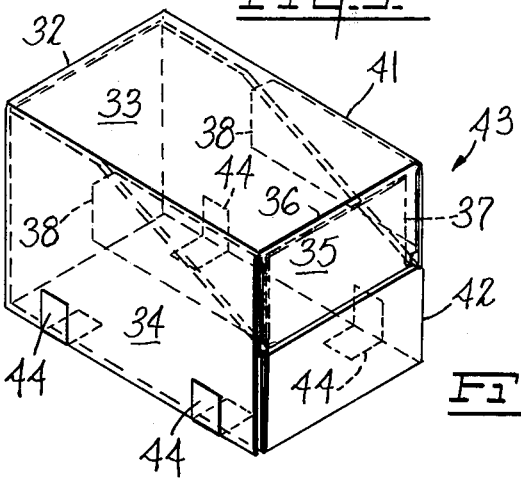
FIGS. 7 through 9 are isometric views of successive steps of the assembly of the container according to the invention following the assembly step shown in FIG. 6.

As exemplified in FIG. 9, the upper cover portion 41 is folded over the filled lower display portion 42 to form shipping container 43. Tabs 38 are situated exteriorally of inner side panels 18, and outer side panels 34 are placed exteriorally of both tabs 38 and inner side panels 18. Tongue 37 is inserted interiorally of lower front panel 35. Outer side panels 34 are secured by four strips of a pressure sensitive adhesive tape 44, two on each side. The container 43 is now ready for shipping.

As an alternative to the method exemplified in FIGS. 8 and 9, top panel 33 is folded over the filled container along crease 32. The upper front panel 35 is folded downwardly along crease 36, and tongue 37 is inserted into the lower display portion of the container immediately rearwardly of lower front panel 25. Side tabs 38 are folded inwardly to overlie inner side panels 18 and outer panels 34 are folded downwardly to overlie both tabs 38 and inner side panels 18. The strips of tape 44 are then applied and the container is ready for shipping.

Figure 10:
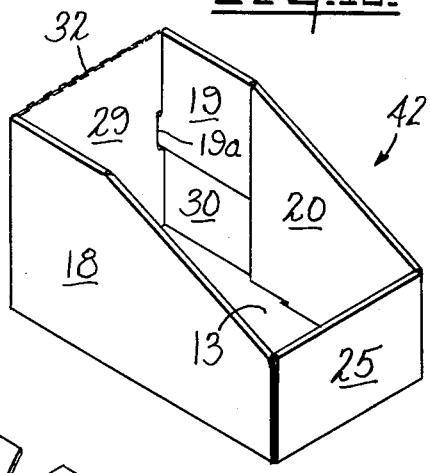
FIG. 10 is an isometric view of the container shown in FIG. 9 with the top portion thereof removed, rendering the package suitable for display purposes.
Figure 7:
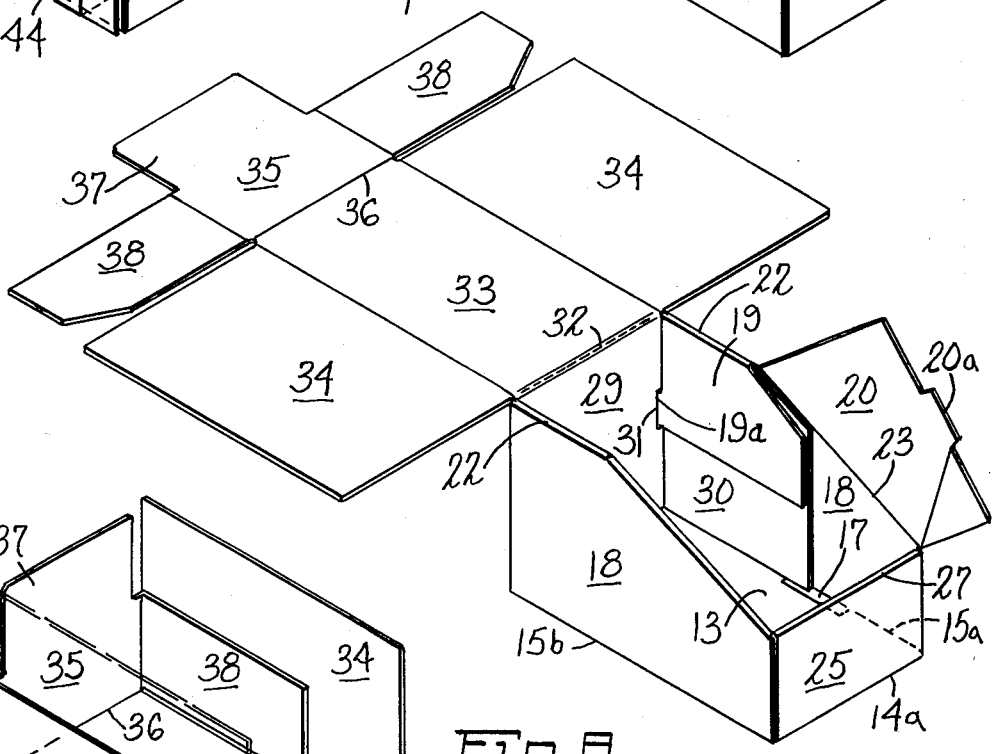

For display purposes, as exemplified in FIG. 10, the cover portion 41 may be removed along crease 32. Lower portion 42 makes a satisfactory display container. Except for crease 32, the only exposed edges are those of creases 22, 23 and 27. The unsightly raw edges of the sheet material forming the blank that are prevalent in prior art display containers are thereby hidden.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What I claim is:

1. A self-joined interlocking container comprising a base panel, two side panels extending upwardly from the base panel, each including an inwardly directed tab along the front thereof, a lower front panel including a flap overlying and locking with said side panel tabs to hold the side panels and lower front panel upright, a rear panel including two forwardly directed tabs, each directed along the inside surface of a side wall, said side panels further including interior flaps overlying and interlocking said rear panel tabs to maintain said rear panel upright, a top panel removably joined to said rear panel and having outer side panels joined thereto adapted to overlay said side panels, an upper front panel extending from said top panel, said upper front panel including side tabs each adapted to be folded rearwardly between a side panel and an outer side panel and a front tab adapted to lie rearwardly of the lower front panel.

2. A self-joined interlocking container comprising a base panel, two side panels extending upwardly from the base panel, each including an inwardly directed tab along the front thereof, a lower front panel including a flap overlying and locking with said side panel tabs to hold the side panels and lower front panel upright, a rear panel including two forwardly directed tabs, each directed along the inside surface of a side wall, said side panels further including interior flaps overlying and interlocking said rear panel tabs to maintain said rear panel upright, each side panel including a rear non-declining portion and a forward declining portion, each non-declining portion having a flap overlaying and interlocking a rear panel tab and a second flap extending downwardly from each declining portion to overlay a portion of a rear panel tab.

3. A blank for a self-joined interlocking container comprising a generally rectangular sheet having a first set of two parallel folding creases and a second set of two parallel folding creases orthogonal to said first set, said creases defining a base panel bounded by both said first set and said second set, a rear panel and a front panel bounded by said first set of creases and on opposite sides of said base panel, two side panels bounded by said second set of creases on opposite sides of said base panel, a pair of tabs extending from opposite sides of said rear panel and bounded by said second set of creases, and a tab extending forwardly of each of said side panels, said front panel having a crease to facilitate said front panel interlocking said side panel tabs, and each of said side panels having a crease defining flaps to facilitate said side panels interlocking said rear panel tabs, a third crease rearwardly bounding said rear panel, and a fourth crease rearward of said third crease, said third and fourth creases and said second set of creases bounding a top panel, said creases further defining a second forward panel bounded by said fourth crease, and a pair of tabs extending on opposite sides from said second front panel, said second front panel tabs being bounded by said second set of creases.

4. A blank as defined in claim 3 in which said sheet has further defined thereon outer side panels extending on opposite sides from said top panel and bounded by said second set of creases.

5. A blank as defined in claim 3 in which said third crease is perforated.

6. A blank as defined in claim 3 in which said side panel flaps each comprise a rear flap and a forward flap, the crease defining each of said rear flaps being parallel to said second set of creases and the crease defining each said forward flap converges toward the proximate crease of said second set of creases.

* * * * *